US006282809B1

(12) United States Patent
Sunde

(10) Patent No.: US 6,282,809 B1
(45) Date of Patent: Sep. 4, 2001

(54) VANE ASSEMBLY FOR DRYING APPARATUS

(75) Inventor: Trond Sunde, Alesund (NO)

(73) Assignee: Articare AS, Stockmarknes (NO)

( * ) Notice: Subject to any disclaimer, the term of this patent is extended or adjusted under 35 U.S.C. 154(b) by 0 days.

(21) Appl. No.: 09/461,003

(22) Filed: Dec. 15, 1999

(51) Int. Cl.[7] ..... F26B 17/24
(52) U.S. Cl. ..... 34/59; 34/135
(58) Field of Search ..... 34/58, 59, 60, 34/61, 182, 135, 166; 110/228, 247, 248, 258, 259; 416/223 B

(56) References Cited

U.S. PATENT DOCUMENTS

| | | | | |
|---|---|---|---|---|
| 3,871,111 | | 3/1975 | Porr . | |
| 5,586,396 | * | 12/1996 | Kanai | 34/59 |
| 5,638,606 | * | 6/1997 | Bryan et al. | 34/59 |
| 5,915,814 | * | 6/1999 | Crews | 34/166 |
| 6,073,364 | * | 6/2000 | McKenzie et al. | 34/166 |
| 6,085,440 | * | 7/2000 | Getler | 34/135 X |

FOREIGN PATENT DOCUMENTS

| | | |
|---|---|---|
| 2239098 | 2/1974 | (DE) . |
| 3819945 | 12/1989 | (DE) . |
| 0696715 | 2/1996 | (EP) . |
| 2019994 | 11/1979 | (GB) . |
| 99/57500 | 11/1999 | (WO) . |

* cited by examiner

*Primary Examiner*—Stephen Gravini
(74) *Attorney, Agent, or Firm*—Browdy and Neimark

(57) ABSTRACT

The present invention relates to a vane assembly for use in a drying apparatus comprising a drying chamber with a heating jacket which is used for drying moist material such as fish offal, food leftovers etc. The drying chamber is substantially cylindrical and has in the preferred embodiment a conical shape with a very small angle. In one embodiment the vane assembly can be employed in a substantially cylindrical drying chamber with straight side walls. The vane assembly is further suited for a drying chamber where the moist material is fed in at the bottom of the drying chamber, either from below, up through the bottom, or from above, through a pipe connection or the like down to the bottom of the chamber, with the result that the supply of the moist material is near the bottom of the drying chamber.

18 Claims, 4 Drawing Sheets

VANE ASSEMBLY FOR DRYING APPARATUS

The present invention relates to a vane assembly for use in a drying apparatus comprising a drying chamber with a heating jacket which is used for drying moist material such as fish offal, food leftovers etc. The drying chamber is substantially cylindrical and has in the preferred embodiment a conical shape with a very small angle. In one embodiment the vane assembly can be employed in a substantially cylindrical drying chamber with straight side walls. The vane assembly is further suited for a drying chamber where the moist material is fed in at the bottom of the drying chamber, either from below, up through the bottom, or from above, through a pipe connection or the like down to the bottom of the chamber, with the result that the supply of the moist material is near the bottom of the drying chamber.

The problems associated with introducing moist material at the bottom of a cylindrical standing drying chamber are particularly related to the fact that the material accumulates near the bottom without being moved and distributed up into the chamber, thus enabling an efficient drying process to be implemented. In a cylindrical chamber it will be desirable to distribute the moist material along the drying chamber's internal surface (heated through the heating jacket), while the material is pushed upwards in the chamber while being subjected to substantially constant movement. For natural reasons the light substances in the moist material, which are also the driest substances, will move to the top layer of the material when the material is moved and the moist, heavier substances will fall to the bottom.

A drying chamber according to the preferred embodiment of the present invention has a substantially conically shaped inside, and is further conically shaped with a positive or negative angle. If the angle is negative relative to the vertical plane, i.e. if the drying chamber has a smaller diameter at its top, the material which moves up in the drying chamber will be pushed inwards and after a while the material at the top, both dry and moist, will fall inwards and down into the centre of the drying chamber. This is therefore a construction of the drying chamber which is suitable for so-called "batch" processes where the chamber is filled with a specific amount of moist material, the material then being moved along the heated internal surfaces of the chamber until the material has attained on average the correct degree of dryness, whereupon the chamber is opened and emptied of the dry material. The moisture which evaporates from the material is continually removed through, for example, a suction device or other form of ventilation of the chamber. If, however, the chamber has a positive conical angle, i.e. if the diameter of the bottom of the chamber is smaller than the diameter of the top of the chamber, the material will be able to be moved along the drying chamber's internal conical surface continuously while at the same time the dry substance at the top will be continuously removed through, for example, a slot in the chamber's side wall while new, moist material is fed into the chamber. The substantially cylindrical drying chamber with a positive conical angle will thus be suited for a continuous drying process with continuous insertion and removal of moist and dry material respectively. In this solution it will also be possible to remove evaporated moisture from the material with a suction device, or other ventilation means in the chamber. Alternatively, an underpressure may be created in the chamber to facilitate the evacuation of evaporated moisture from the material supplied. The features related to a conical construction of a substantially cylindrical drying chamber are further described in the applicant's international patent application, PCT/NO99/00061, filed on Feb. 25, 1999 with priority from Apr. 23, 1998, in Norwegian patent application 19981835.

As stated in the applicant's previously filed patent application it is necessary to provide a vane assembly, at least in the drying chamber's lower part, in order to move the moist material in the chamber, while at the same time it is desirable to distribute the material in the best possible fashion along the drying chamber's side walls as well as moving the material upwards in the drying chamber. If the moist material is inserted at or through the bottom of the drying chamber it will also be necessary for the vane assembly to lift the material from the underside of the vane assembly, up into the drying chamber. It may also be necessary to attach guiding vanes on the underside of the vane assembly, to move the material to the point or points where the material is lifted past the vane assembly, to avoid accumulation of material under the vane assembly. It will thereby be possible to insert the moist material through the bottom of the drying chamber, e.g. by means of a transport screw or the like, or the material may be inserted, for example, through the drying chamber's upper part or lid, preferably centrally in the chamber with a pipe connection or the like which passes the material from the drying chamber's upper part to the drying chamber's bottom, for example close to the lower part of the vane assembly.

It is therefore an object of the vane assembly in the drying chamber according to the present invention to lift the material which is located under the vane assembly's underside, between the vane assembly and the bottom of the drying chamber, and then bring this material up past the vane assembly. It is further an object of the vane assembly according to the present invention to bring the material out towards the drying chamber's side walls and in alternative embodiments of the vane assembly according to the invention it is an object to bring the material further up in the drying chamber in one or more stages or levels. The vane assembly may thereby be adapted to different constructions of the drying chamber according to that which is stated herein, and can thus be used in substantially cylindrical drying chambers with straight or conical walls, where the conicity can vary from a negative to a positive angle relative to the drying chamber's straight wall. It is a further object of a vane assembly according to the present invention that it can be rotated by a motor, or example on the bottom of the drying chamber. It is also an object that the vane assembly according to the present invention should satisfy the general requirements for a mechanical structure of this type with regard to accessibility for inspection, etc.

European patent publication EP-A2-0,696,715 discloses a cylindrical drying chamber with straight walls where there is mounted, in the immediate vicinity of the bottom of the drying chamber, a rotating vane assembly which distributes the material in the drying chamber and lifts the material upwards in the drying chamber through vane sections extending obliquely upward in the direction opposite to the rotating direction. The disadvantage of this known solution is however that moist material will become packed under the assembly, without the assembly being able to move this packed, moist material past the assembly in the direction of the upper part of the drying chamber, which could prevent the assembly from efficiently pushing material up into the chamber as well as keeping the material in motion In order to overcome the drawbacks which are associated with previously known solutions, as well as fulfil the objects which are described above, according to the present invention a vane assembly is provided which is rotatingly arranged in a substantially cylindrical drying chamber with straight or conical side walls, which drying chamber is substantially provided with a heating jacket which contains or circulates a heated medium for heating lip the drying chamber's internal wall and surface. The drying chamber is further provided with a feed channel for moist material and an outlet for vapour or moist air, in addition to a slot or opening for removing dry material as desired.

Further scope of applicability of the present invention will become apparent from the detailed description given hereinafter. However it should be understood that the detailed description and specific examples, while indicating preferred embodiments of the invention, are given by way of illustration only, since various changes and modifications within the spirit and scope of the invention will become apparent to those skilled in the art form this detailed description.

A vane assembly according to the present invention is further described and exemplified in the accompanying drawings, in which.

Figure 1:
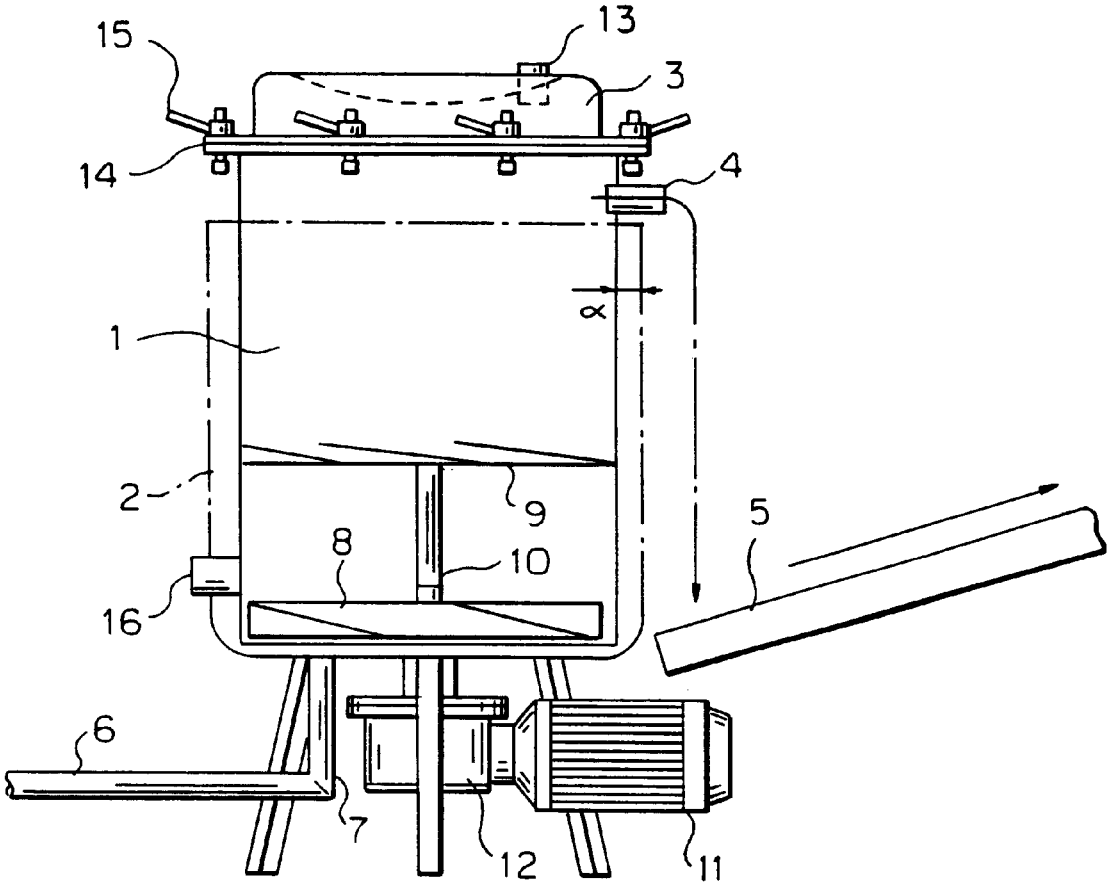
FIG. 1 illustrates in a section from the side a drying chamber with a vane assembly according to the present invention.

In FIG. 1 there is illustrated a substantially cylindrical drying chamber 1 with a positive conical angle a relative to a straight-sided cylindrical drying chamber. This means that the drying chamber's upper diameter is greater than the drying chamber's lower diameter and according to the introduction a drying chamber of this kind is particularly suitable for a continuous drying process where dried material is removed from the upper part of the chamber while at the same time moist material is inserted during continuous operation. The drying chamber 1 furthermore has an externally provided heating jacket 2 in which there circulates a heated medium, such as oil, steam or water, which help to keep the inner wall of the drying chamber 1 at the correct temperature in relation to the drying process. By circulating the heated medium while at the same time the medium is removed from the heating jacket and heated up before being fed in again continuously, an even temperature is maintained over the whole of the interior of the drying chamber, both along the drying chamber's circumference and in the drying chamber's height. Moreover, the upper end of the drying chamber 1 is provided with a lid 3 which is connected to the drying chamber 1 by a flance connection 14 which is locked by bolts 15 along the lid's 3 circumference. The lid is further provided with an exhaust nozzle 13 for removing moist evaporation and air from the drying chamber 1 and is provided at its upper end with an outlet 4 where dry material is removed and falls down on to a transporter 5 for further processing. In FIG. 1 the underside of the drying chamber 1 is further provided with a feed 6 for dry material which through a lead-in device 7 pushes moist material through the bottom of the drying chamber, up under the vane assembly 8 which according to the present invention distributes the moist material along the drying chamber's 1 circumference and pushes the material up into the drying chamber.

The vane assembly 8 is further arranged on a shaft 10 substantially extending along the drying chamber's cylinder axis and in an alternative embodiment of the present invention there are provided on the same shaft 10 one or more upper vane assemblies 9 which further assist in lifting the material which is in the drying chamber 1. The shaft 10 is driven by a motor 11, via a drive gear 12 and the motor may further be controlled by, e.g., a programmable logic control, PLC (not shown) which reads a plurality of parameters in connection with the drying chamber. The material which is removed through the opening 4 in the drying chamber's upper part is further removed by a transporter 5. If a suction device is provided in the nozzle 13 thus creating a vacuum in the drying chamber 1, at the outlet opening 4 and the lead-in 7 there must be provided so-called underpressure sluices or traps where the material which has to be removed or inserted is passed into a sluice before the entrance to the sluice is closed to the drying chamber, whereupon the opposite end of the sluice is opened and the removed or inserted material is further conveyed out of the underpressure trap. The outer opening of the underpressure trap then closes whereupon the inner opening of the underpressure trap is opened to the drying chamber 1. The volume of the underpressure trap should be so small in relation to the total volume of the drying chamber 1 that the variation in underpressure when opening/closing the underpressure trap will be minimal. This may be compensated for by supplying additional suction when the underpressure trap is opened or closed in order to compensate for the lost underpressure when opening and closing the trap. This too may be controlled by a PLC (programmable logic control, not shown).

The insertion of moist material in the lead-in device 7 on the underside of the drying chamber may further be implemented by means of a transport screw or the like, if the natural pressure against the moist material as a result of an additional supply of moist material is not sufficient to push the moist material into the interior of the drying chamber 1, or through an underpressure trap on the way into the interior of the drying chamber 1.

An alternative insertion of moist material may be implemented through the opening 16 of the drying chamber 1. If the alternative insertionpoint 16 for moist material is employed, then the opening 16 must be provided with a closing mechanism, thus preventing dry or half-dry material from being flung out of the opening 16 during the drying process.

A further embodiment is associated with the introduction of moist material through the drying chamber's lid 3 where ordinary gravity is utilised for feeding in the material. By means of a drive device for moist material provided upstream of the drying device, it will be possible to have moist material fed into an opening in the lid 3 and on through a pipe connection or the like down to, or past the vane assembly 8 in the drying chamber 1 (not shown). According to an alternative embodiment, a feed pipe of this kind will have to be able to rotate with the vane assembly 8 and possibly 9, which requires the pipe feed to be connected to an annulus or the like in the lid 3 where moist material is continuously supplied, subsequently running down through the feed pipe for moist material to the bottom of the drying chamber 1.

Figure 2:
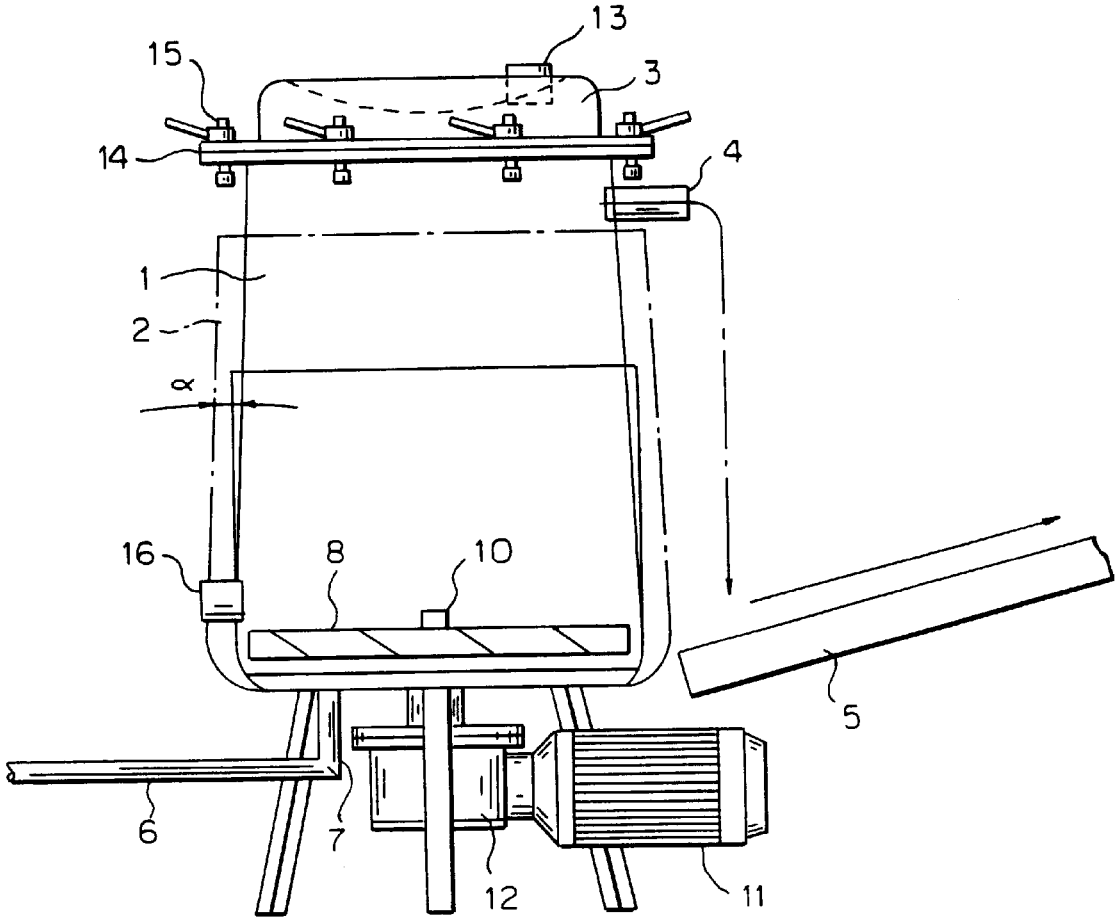
FIG. 2 illustrates an alternative embodiment of the drying chamber as illustrated in FIG. 1.

In FIG. 2 there is illustrated a further embodiment of the drying chamber as shown in FIG. 1, where the drying clhamber's conical side walls have a negative conical angle $\alpha$ relative to a drying chamber with straight walls. According to the above this is a chamber which is particularly suitable for "batch" processes where moist material is fed into the chamber, whereupon the vane assembly 8 and possibly 9 is set in motion by the motor 11 via a drive gear 12 whereupon the moist material is moved outwards and upwards in the chamber before being forced in towards the middle due to the drying chamber's 1 conicity, and finally the material falls in towards the middle and down towards the vane assembly 8, thus rotating the moist material in the drying chamber 1. When the material in the drying chamber 1 has been sufficiently dried the vane assembly 8, 9 is stopped. The lid 3 is removed by opening the screw connections 15 holding the flanges 14 and the dried material in the interior of the drying chamber 1 is removed before new moist material is fed into the chamber. Alternatively, the dry material may be removed through any opening or slot in the drying chamber 1.

Figure 3:
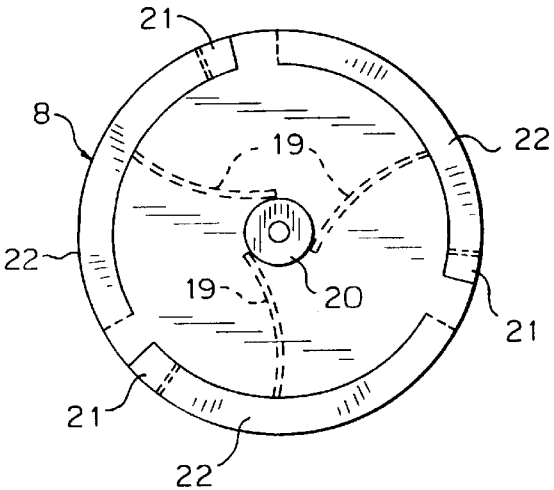
FIG. 3 is a plan view from above of a lower vane assembly according to the present invention.

FIG. 3 illustrates in a plan view from above a vane assembly 8 for mounting in a drying chamber as illustrated in FIG. 1 or 2, possibly a drying chamber with straight sides. The vane assembly 8 is mounted on the shaft 10 in FIGS. 1 and 2 with a central bearing or attachment 20 which connects the vane assembly 8 with the shaft 10. Furthermore, at a distance from the outer circumference, in the direction of the bearing or the attachment 20, substantially perpendicularly on the circumference, the vane assembly 8 has one or more scraping bodies 21 on the underside of the vane assembly 8, which scraping bodies 21 are downwardly projecting at an angle and downwardly slanting against the direction of rotation. The object of these scraping bodies 21 is to move material from the underside of the vane assembly 8, in the area between the vane assembly 8 and the bottom of the drying chamber 1 lip past the vane assembly 8, in order to prevent especially the moist material from becoming packed together in this area, while at the same time helping to lift the moist material a first distance up into the drying chamber 1. Furthermore, on the top of the vane assembly 8, along a part of the vane assembly's circumference there are arranged tilted, curved surfaces which rise over a part of the vane assembly's circumference from the upper termination of the tilted scraping elements 21 to a height over the upper termination of the scraping body 21 in a curved section of the vane assembly's circular shape substantially along the circumference of the vane assembly. In an alternative embodiment the rising plate-shaped parts may form an angle relative to the plane of rotation, with the result that they rise to a higher level at the vane assembly's outer circumference relative to the inner circumference of the rising plate bodies 22. In FIG. 3 three such rising plate-shaped elements are shown formed along the vane assembly's 8 circumference, where each of the rising elements extends over approximately 120° of the vane assembly's circumference. In alternative embodiments one or more rising plate-shaped elements may be provided with the object of bringing the moist material to a higher level in the drying chamber 11

In a preferred embodiment, on the underside of the vane assembly 8 there are mounted one or more guides 19 which extend in a preferably curved shape from substantially the centre 20 of the vane assembly towards the circumference of the vane assembly. These guides 19 guide material out towards the chamber's walls, towards the area where the scraping bodies are located. The lead-in part of the guides 19 are at the innermost part of the vane assembly 8 approximately tangentially arranged in relation to the centre, 20. The guides 19 can also, or alternatively be arranged on the upper side of the vane assembly to move moist or dry material towards the circumference of the vane assembly. In these embodiments the end of the guide 19 is preferably in the vicinity of the lower part of the plate bodies 22.

The moist material located between the vane assembly 8 and the bottom of the drying chamber 1 is thereby first conveyed out towards the circumference of the vane assembly 8 by the curved guide bodies 19 on the underside of the vane assembly 8, whereupon the moist material is removed from the underside of the vane assembly 8 by the tilted scraping devices 21 which bring the moist material to the upside of the vane assembly 8, whereupon the rising, oblique, plate-shaped elements 22 further bring the moist material to a higher level in the drying chamber, along the vane assembly's circumference.

In an embodiment the vane assembly 8 may be formed from a circular plate which constitutes a blank for the formation of a vane assembly 8. Along the circumference of the blank perpendicular incisions are made at one or more points, which incisions are of substantially the same size in part of the blank's radius, whereupon a curved cut is made parallel to the outer circumference at a distance from the next perpendicular incision. The distance between the next perpendicular incision and the curved cut parallel to the outer circumference will form a segment of the blank which can be bent towards the underside of the vane assembly 8 in order to form the scraping elements 21. Furthermore, those parts of the blank which are located between the outer circumference and the curved cut parallel to the circumference are bent at their attachment point, with the result that this or these curved plate segments form the rising surfaces 22. If the blank is made of a relatively soft material, such as aluminium or the like, in an alternative embodiment a stiffening element may be provided between the substantially plane part of the vane assembly 8 and the rising curved plate segments 22 at one or more points.

Figure 4:
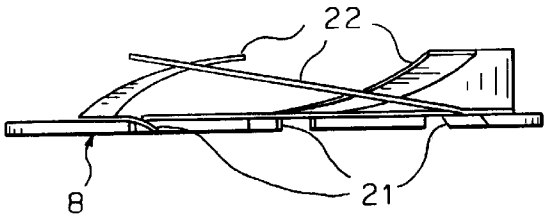
FIG. 4 is a view from the side of the vane assembly illustrated in FIG. 3.

In FIG. 4 the vane assembly 8 as illustrated in FIG. 3 is further illustrated from the side, where on the underside of the vane assembly there are mounted downwardly slanting scraping devices 21, together with guides 19 substantially from the centre of the vane assembly 8 towards the outer circumference of the vane assembly 8, while on the top of the vane assembly 8 there are formed curved rising plate segments 22 which lift material in the drying chamber 1 to a higher level in the drying chamber.

Figure 5:
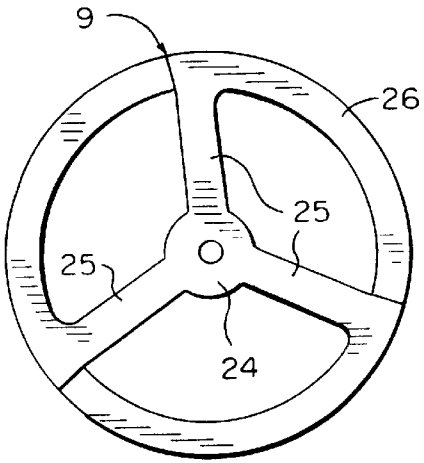
FIG. 5 is a plan view from above of an upper vane assembly according to the present invention.

In FIG. 5 moreover there is illustrated a further vane assembly 9 which is mounted above the vane assembly 8 in an alternative embodiment in order to further bring the material in the drying chamber to a higher level. The vane assembly 9 is substantially in the shape of an open ring with spokes and a central fulcrum 24 for mounting on the shaft 10 as illustrated in FIGS. 1 and 2. As shown in FIG. 5 the ring is broken at three different points with an angular spacing of 120°, and the breaks are preferably placed on one side of each spoke 25. This forms three openings 23 between the central area 24 and the ring 26 where material can fall down into the centre of the drying chamber before being moved up in the drying chamber again. Each of the broken surfaces 26 is bent at its attaching spoke in such a manner that the broken segments of the ring 26 form rising surfaces from the plane of the spokes 25 and the central portion 24 to a desired height above this plane. As in the case of similar surfaces in the vane assembly 8, the object of the tilted curved surfaces 26 is to move material to a higher level in the drying chamber 1.

Figure 6:
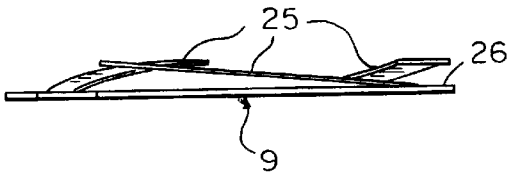
FIG. 6 is a view from the side of the vane assembly illustrated in FIG. 5.

In FIG. 6 the vane assembly 9 as illustrated in FIG. 5 is illustrated in a plan view from the side and unlike the vane assembly 8 it can be clearly seen that the vane assembly 9 only has rising surfaces on the top which help to raise the material in the drying chamber.

A vane assembly for mounting in a drying chamber 1 can thereby comprises one or more lower vane assemblies 8 in the drying chamber 1, and can be combined with a number of upper vane assemblies 9 which together help to raise the material in a drying chamber to the desired height. It is also possible to adjust the height which each individual vane assembly 8 or 9 helps to give the material in the drying chamber, and this is controlled by the angle assumed by the curved rising surfaces relative to the vane assembly's plane of rotation with the central area 20 and 24.

Figure 7:
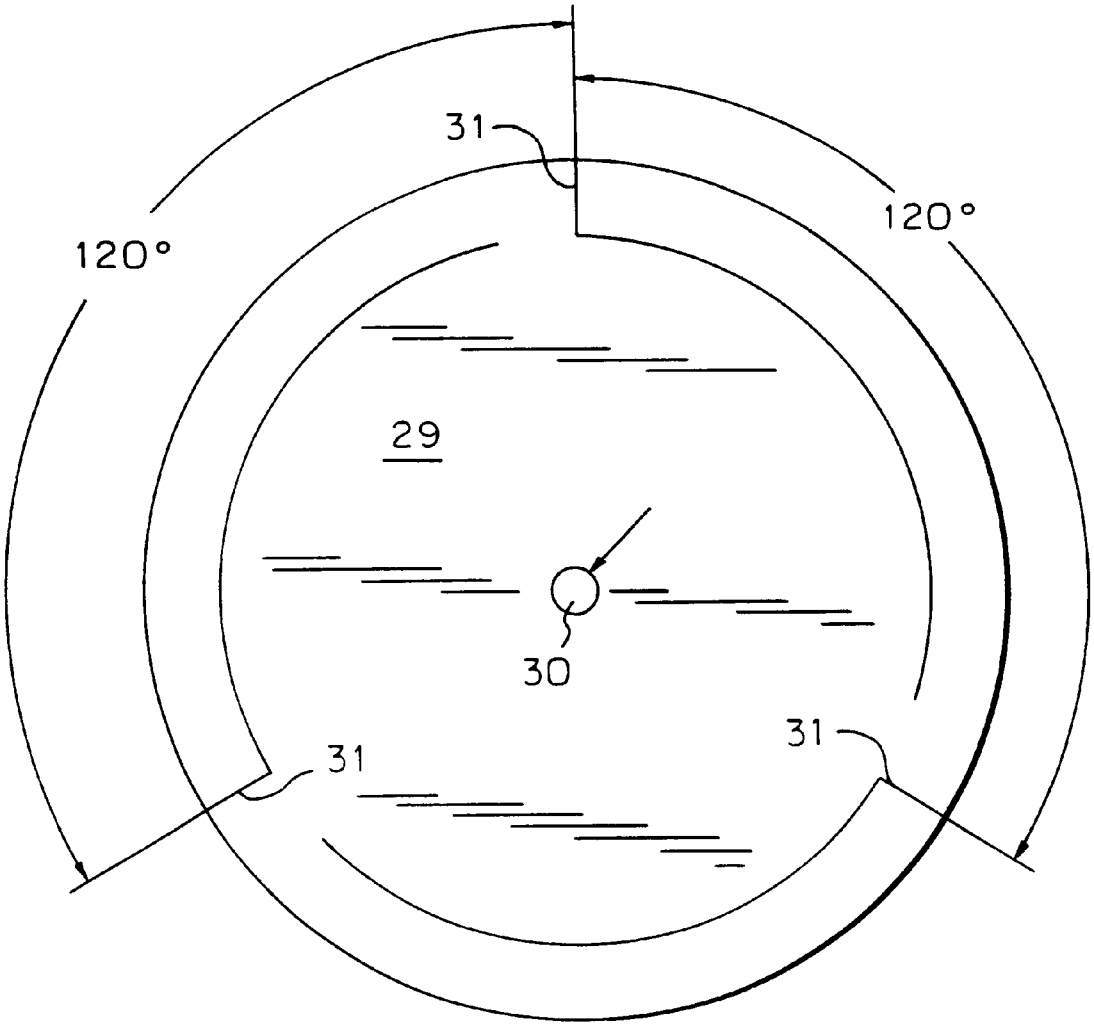
FIG. 7 is a plan view from above of an embodiment of an upper vane assembly according to the present invention.

There is further illustrated in FIG. 7 an embodiment of the vane assembly 9 as shown in FIGS. 5 and 6 where the vane assembly 9 is formed from a whole plate with a centrally arranged hole 30 for mounting on the shaft 10 as illustrated in FIGS. 1 and 2. While one or more perpendicular incisions 31 are formed along the circumference of the plate 29, as illustrated in FIG. 7, three perpendicular incisions with 120° angular difference are formed, and from the inner end of the perpendicular incisions there are formed curved cuts parallel to the circumference of the plate 29 at a distance from the next perpendicular incision. In this manner three curved surfaces are formed along the circumference of the vane assembly 9 which can be bent at their attachment point to the surface 29 thereby forming an angle with the plate 29 and thus in the same way as with the vane assembly 8 and 9 forming tilted rising curved surfaces which assist in raising the material in the drying chamber 1.

The invention being thus described, it will be obvious that the same may be varied in many sways. Such variations are not to be regarded as a departure from the spirit and scope of the invention, and all such modifications as would be obvious to one skilled in the art are intended to be included within the scope of the following claims.

What is claimed is:

1. A vane assembly for use in a drying chamber, said drying chamber being substantially cylindrical with straight or conical side walls, which drying chamber is provided with a heating jacket around at least part of the walls to heat the walls on the inside of the chamber, in which jacket a heated medium circulates, which drying chamber further has a supply opening for moist material, an outlet opening for dried material and an opening for expelling moist air, in addition to which said vane assembly is mounted in the drying chamber on a driven shaft extending along the drying chamber's cylinder axis, said vane assembly being mounted for rotation in a given direction about the cylinder axis, along the circumference of which vane assembly there are provided oblique, plate-shaped elements which raise the material from the vane assembly towards the upper area of the drying chamber, characterized in that said vane assembly is provided with one or more guide surfaces formed at an angle relative to the vane assembly's plane of rotation and extending substantially from the center of the vane assembly towards the outer edge of the vane assembly, and said vane assembly further comprises at least one scraping body that is inclined downwardly in the given direction for moving the material from the underside of the vane assembly to the upper side of the vane assembly.

2. A vane assembly according to claim 1, characterized in that said guide surfaces are provided on the lower side of the vane assembly facing the bottom of the drying chamber.

3. A vane assembly according to claim 1, characterized in that said guide surfaces are provided on the upper side of the vane assembly facing the bulk volume of the drying chamber.

4. A vane assembly according to claim 3, characterized in that said guide surfaces are curved.

5. A vane assembly according to claim 1, characterized in that said guide surfaces have a lead-in area in the vicinity of the centre of the vane assembly, which lead-in area is formed substantially tangentially to the centre of the vane assembly.

6. A vane assembly for use in a drying chamber, said drying chamber being substantially cylindrical with straight or conical side walls, which drying chamber is provided with a heating jacket around at least part of the walls to heat the walls on the inside of the chamber, in which jacket a heated medium circulates, which drying chamber further has a supply opening for moist material, an outlet opening for dried material and an opening for expelling moist air, in addition to which said vane assembly is rotatingly mounted in the drying chamber on a driven shaft extending along the drying chamber's cylinder axis, said vane assembly being mounted for rotation in a given direction about the cylinder axis, along the circumference of which vane assembly there are provided oblique, plate-shaped elements which raise the material from the vane assembly towards the upper area of the drying chamber, characterized in that that the vane assembly on the side towards the bottom of the drying chamber is formed with at least one scraping body that is inclined downwardly in the given direction for moving the material from the underside of the vane assembly to the upper side of the vane assembly.

7. A vane assembly according to claim 6, characterized in that said scraping bodies slant in the opposite direction of the rotation of the vane assembly.

8. A vane assembly according to claim 6, characterized in that said scraping bodies are formed over at least a distance of the vane assembly between the centre and the outer rim.

9. A vane assembly according to claim 6, characterized in that the upper part of said scraping bodies are located in the vicinity of the bottom part of the obliquely plate shaped elements on the upperside of the vane assembly.

10. A vane assembly according to claim 8, characterized in that the upper part of said scraping bodies are located in the vicinity of the bottom part of the obliquely plane shaped elements on the upper side of the vane assembly.

11. A vane assembly according to claim 7, characterized in that the upper part of said scraping bodies are located in the vicinity of the bottom part of the obliquely plate shaped elements on the upper side of the vane assembly.

12. A vane assembly according to claim 7, characterized in that said scraping bodies are formed over at least a distance of the vane assembly between the centre and the outer rim.

13. A vane assembly according to claim 12, characterized in that the upper part of said scraping bodies are located in the vicinity of the bottom part of the obliquely plate shaped elements on the upper side of the vane assembly.

14. A vane assembly according to claim 3, characterized in that said guide surfaces are curved.

15. A vane assembly according to claim 14, characterized in that said guide surfaces have a lead-in area in the vicinity of the center of the vane assembly, which lead-in area is formed substantially tangentially to the centre of the vane assembly.

16. A vane assembly according to claim 2, characterized in that said guide surfaces have a lead-in area in the vicinity of the center of the vane assembly, which lead-in area is formed substantially tangentially to the centre of the vane assembly.

17. A vane assembly according to claim 3, characterized in that said guide surfaces have a lead-in area in the vicinity of the center of the vane assembly, which lead-in area is formed substantially tangentially to the centre of the vane assembly.

18. A vane assembly according to claim 4, characterized in that said guide surfaces have a lead-in area in the vicinity of the center of the vane assembly, which lead-in area is formed substantially tangentially to the centre of the vane assembly.

* * * * *